US006434886B1

(12) United States Patent
Johnson et al.

(10) Patent No.: US 6,434,886 B1
(45) Date of Patent: Aug. 20, 2002

(54) RELEASABLE VERTICAL LIFT OVERHEAD DOOR

(75) Inventors: Andrew P. Johnson, Waterford; David Stiltner, Warren, both of MI (US)

(73) Assignee: Door-Man Manufacturing Company, Auburn Hills, MI (US)

( * ) Notice: Subject to any disclaimer, the term of this patent is extended or adjusted under 35 U.S.C. 154(b) by 0 days.

(21) Appl. No.: 09/701,164

(22) PCT Filed: May 28, 1999

(86) PCT No.: PCT/US99/11972

§ 371 (c)(1),
(2), (4) Date: Nov. 22, 2000

(87) PCT Pub. No.: WO99/61737

PCT Pub. Date: Dec. 2, 1999

Related U.S. Application Data

(60) Provisional application No. 60/087,290, filed on May 29, 1998.

(51) Int. Cl.[7] ..... E05D 15/38
(52) U.S. Cl. ..... 049/197; 160/205
(58) Field of Search ..... 49/197; 160/201, 160/205, 273.1, 265

(56) References Cited

U.S. PATENT DOCUMENTS 4,114,424 A 9/1978 Johnson
4,202,201 A 5/1980 Johnson
5,025,847 A 6/1991 Mueller
5,163,494 A 11/1992 MacNeil et al.
5,168,915 A 12/1992 Lafleur
5,222,541 A 6/1993 Hornberger
5,271,448 A 12/1993 Delgado
5,482,104 A 1/1996 Lichy
5,535,805 A 7/1996 Kellogg et al.
5,584,333 A 12/1996 Torchetti et al.
5,601,133 A 2/1997 Krupke et al.
5,632,317 A 5/1997 Krupke et al.
5,720,332 A 2/1998 Nachreiner
5,829,504 A 11/1998 Ekstrand et al.
5,887,385 A 3/1999 Horner et al.
5,927,368 A 7/1999 Rohrer et al.

*Primary Examiner*—Gregory J. Strimbu
(74) *Attorney, Agent, or Firm*—Bliss McGlynn, P.C.

(57) ABSTRACT

A releasable vertical lift overhead door for an opening of a structure includes a plurality of tracks with one of a pair of the tracks adapted to be disposed on a side of the opening of the structure and another of the pair of the tracks adapted to be disposed on another side of the opening and at least one door leaf disposed between the pair of the tracks. The releasable vertical lift overhead door also includes a release assembly attached to the at least one door leaf on each side thereof. Each release assembly has a support bracket attached to the at least one door leaf and a guide bar disposed within the support bracket for receiving a portion of one of the tracks to guide movement of the at least one door leaf along the tracks. The guide bars releasably disengage the pair of the tracks when a force of a predetermined magnitude is applied to the at least one door leaf.

33 Claims, 8 Drawing Sheets

RELEASABLE VERTICAL LIFT OVERHEAD DOOR

CROSS-REFERENCE TO RELATED APPLICATION(S)

The present application is a national phase application under 35 U.S.C. 371 of PCT Application International Serial No. PCT/US99/11972, which claims the priority date of copending U.S. Provisional Patent Application Serial No. 60/087,290 filed May 29, 1998.

BACKGROUND OF THE INVENTION

1. Field of the Invention

The present invention relates generally to overhead doors and, more particularly, to a releasable vertical lift overhead door.

2. Description of the Related Art

It is known to provide a sectional overhead door to close an opening in a building such as a warehouse. An example of such an overhead door is disclosed in U.S. Pat. No. 5,720,332 to Nachreiner. This overhead door typically includes a plurality of panels pivotally connected to one another by hinges for extension transversely across the opening. Vertical sides of the panels include roller assemblies for rotational engagement within guide trackways to provide guided movement of the door within the guide trackways from an open position to a closed position.

It is also known that these overhead doors are commonly damaged by material handling equipment, requiring repair or replacement of the door. As a result, it is known to provide a release assembly for an overhead door to release the door from its associated track upon being exposed to a force of a predetermined magnitude. An example of such a release assembly is disclosed in U.S. Pat. No. 5,535,805 to Kellogg et al.

One disadvantage of the above release assembly is that a plunger fits into a track which is undesired. Another disadvantage of the release assembly is that it is provided only on sectional doors. Yet another disadvantage of the release assembly is that it is provided only on doors that are spring counterbalanced and is mounted to a face of the door. Still another disadvantage of the release assembly is that it is cumbersome and complex in its arrangement. A further disadvantage is that the release assembly is relatively costly to manufacture and maintain. Thus, there is a need in the art for a vertical lift overhead door having a release assembly.

SUMMARY OF THE INVENTION

It is, therefore, one object of the present invention to provide a new releasable vertical lift overhead door.

It is another object of the present invention to provide a new releasable vertical lift overhead door having either a one leaf or two leaf door.

It is yet another object of the present invention to provide a vertical lift overhead door that releases from its track when exposed to a force of a predetermined magnitude.

To achieve the foregoing objects, the present invention is a releasable vertical lift overhead door. The releasable vertical lift overhead door includes at least one track disposed on each side of an opening of a structure and at least one door leaf disposed between the tracks. The releasable vertical lift overhead door also includes a release assembly attached to the door leaf on each side thereof and having a portion disposed over the track to guide movement of the door leaf along the tracks and to releasably disengage the track when a force of a predetermined magnitude is applied to the door leaf.

One advantage of the present invention is that a new releasable vertical lift overhead door is provided. Another advantage of the present invention is that a releasable vertical lift overhead door is provided having one or two door leafs. Yet another advantage of the present invention is that a vertical lift overhead door is provided with a release assembly on a door leaf that fits over a track and releases from the track when the door leaf is exposed to a force of a predetermined magnitude.

Other objects, features and advantages of the present invention will be readily appreciated as the same becomes better understood after reading the subsequent description when taken in conjunction with the accompanying drawings.

DESCRIPTION OF THE PREFERRED EMBODIMENT(S)

Figure 1:
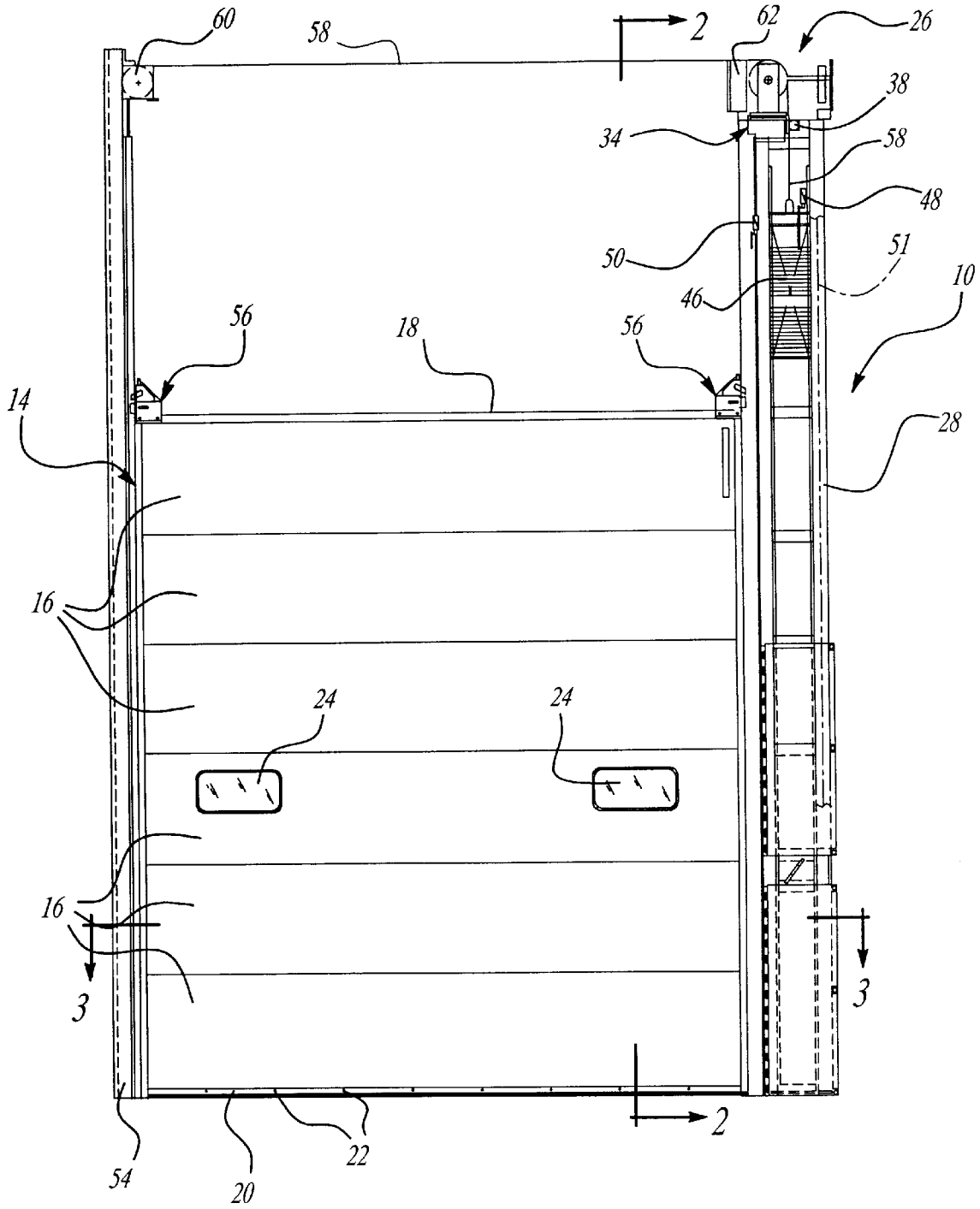
FIG. 1 is a front elevational view of a releasable vertical lift overhead door, according to the present invention.
Figure 2:
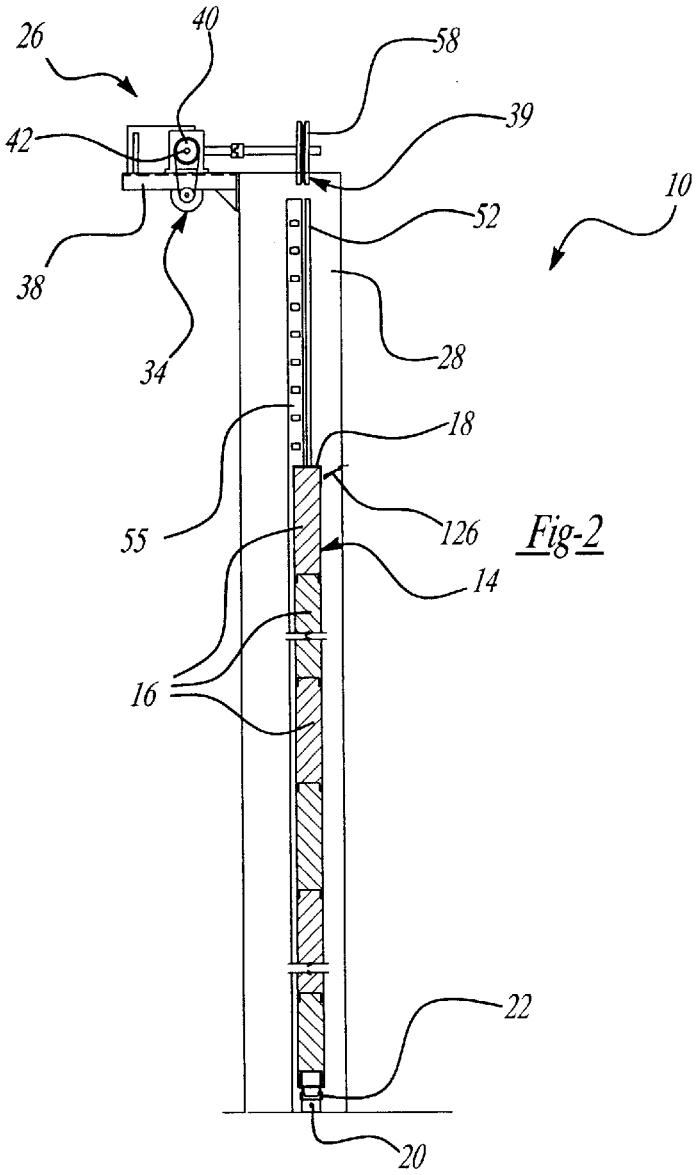
FIG. 2 is a sectional view taken along line 2—2 of FIG. 1.
Figure 3:
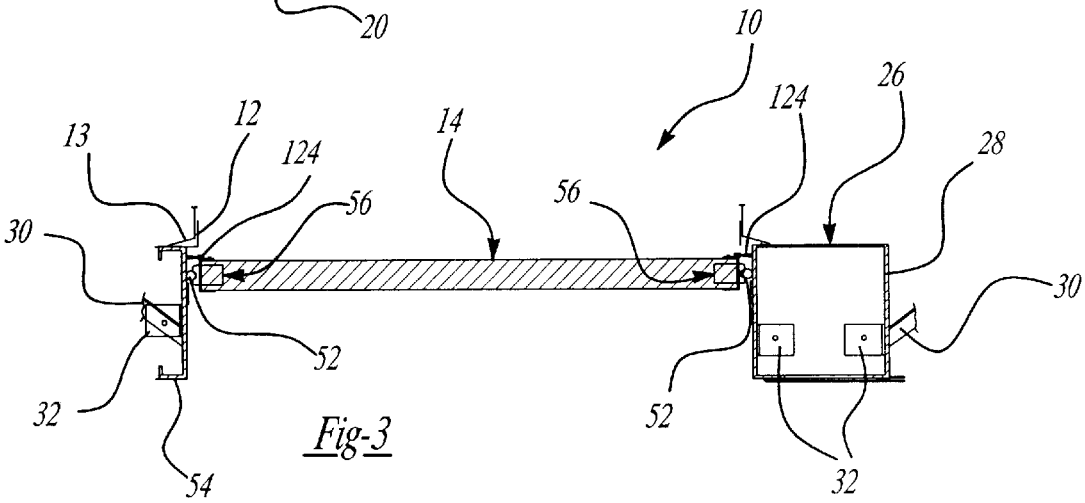
FIG. 3 is a sectional view taken along line 3—3 of FIG. 1.

Referring to the drawings and in particular FIGS. 1 through 3, one embodiment of a releasable vertical lift overhead door 10, according to the present invention, is shown for closing an opening 12 of a structure 13 (partially shown) such as a warehouse. The releasable vertical lift overhead door 10 includes a door leaf, generally indicated at 14. The door leaf 14 is of a single or one leaf type having a plurality of panels 16 interlocked vertically together and being generally planar. The panels 16 are generally rectangular and extend transversely substantially the entire width of the opening 12. It should be appreciated that the panels 16 are fixed and do not rotate relative to each other.

The door leaf 14 includes a top cap 18 disposed over an upper surface of a top panel 16. The top cap 18 is a generally inverted U-shape member extending transversely along and secured to the top panel 16 by suitable means such as fasteners (not shown). The door leaf 14 also includes a boot 20 extending along a lower surface of a bottom panel 16. The boot 20 is an elastomeric or rubber member extending transversely and removably secured to the bottom panel 16 by suitable means such as fasteners 22. The door leaf 14 may also include one or more vision lites 24. The vision lite 24 is a window or transparent panel disposed in an opening in one of the panels 16. Preferably, the panel 16 has a pair of transversely spaced vision lites 24. It should be appreciated that the door leaf 14 extends the entire height of the opening 12 and is disposed on an interior side of the opening 12.

The releasable vertical lift overhead door 10 also includes a lift assembly, generally indicated at 26, for lifting and lowering the door leaf 14 to open and close the opening 12. The lift assembly 26 includes a tower 28 mounted to the structure 13 such as a jamb of the opening 12 on one side of the opening and extending vertically. The tower 28 is generally rectangular in shape and extends vertically past the height of the opening 12. The tower 28 is secured to a wall and floor of the structure 13 by suitable means such as bracing 30 and floor anchor angle clips and bolts 32. It should be appreciated that the tower 28 is conventional and known in the art.

The lift assembly 26 also includes a motor assembly, generally indicated at 34, electrically connected to a source of power such as a control panel (not shown) and mounted on a top of the tower 28 by suitable means such as bracing 38 and fasteners (not shown). The motor assembly 34 includes a drive drum assembly 39. The motor assembly 34 includes a rotatable shaft 40 and a pulley 42 rotated by the shaft 40. The drive drum assembly 39 is operatively connected to the pulley 42. The motor assembly 34 has a preferably 1 H.P. type motor, solenoid brake, hand chain operator and hand chain disconnect switch. It should be appreciated that the motor assembly 34 is conventional and known in the art.

The lift assembly 26 also includes a metal wire rope cable 58 operatively connected to the drive drum assembly 39 by suitable means (not shown) and extending downwardly into the tower 28. The lift assembly 26 includes a counterweight box 46 disposed in the tower 28 and having one end attach to one end of the metal wire rope cable 58. The counterweight box 46 has a ballast and a plurality of guide bars. The lift assembly 26 includes a close limit switch 48 disposed outside the tower 28. The close limit switch 48 is tripped by the counterweight box 46. The lift assembly 26 also includes an open limit switch 50 mounted on an outside at the tower 28. The open limit switch 50 is tripped by the door leaf 14. The lift assembly 26 includes a jack chain 51 operatively attached to the shaft 40 by suitable means such as a coupling (not shown) to allow hand operation to rotate the shaft 40 to lift and lower the door leaf 14. It should be appreciated that the limit switches 48 and 50 are connected to a source of power such as a control panel (not shown).

The releasable vertical lift overhead door 10 includes a track 52 disposed along each side of the opening 12. The track 52 has a generally circular cross-sectional shape and extends vertically along an outer surface of the tower 28 on one side and an outer surface of a track support member 54 on the other side and secured thereto by suitable means such as welding. The releasable vertical lift overhead door 10 may have a guide 55 disposed along each side of the track 52 and secured to the tower 28 and track support member 54 by suitable means such as welding.

The releasable vertical lift overhead door 10 includes a release assembly, generally indicated at 56, attached to a top edge of the door leaf 14 on each side thereof and engageable with the tracks 52. The releasable vertical lift overhead door 10 also includes a metal wire rope cable 58 having an end connected to the release assembly 56 and extending over a rotatable guide sheave 60 attached to the track support member 54 and extending over the drive drum assembly 39 and attached by suitable means to the counterweight box 46. The metal wire rope cable 58 also has an end attached to the other release assembly 56 and extending over a rotatable guide sheave 62 and extending over the drive drum assembly 39 and attached to the counterweight box 46 by suitable means. It should be appreciated that the motor assembly 34 lifts and lowers the door leaf 14 with the metal wire rope cable 58.

Figure 4:
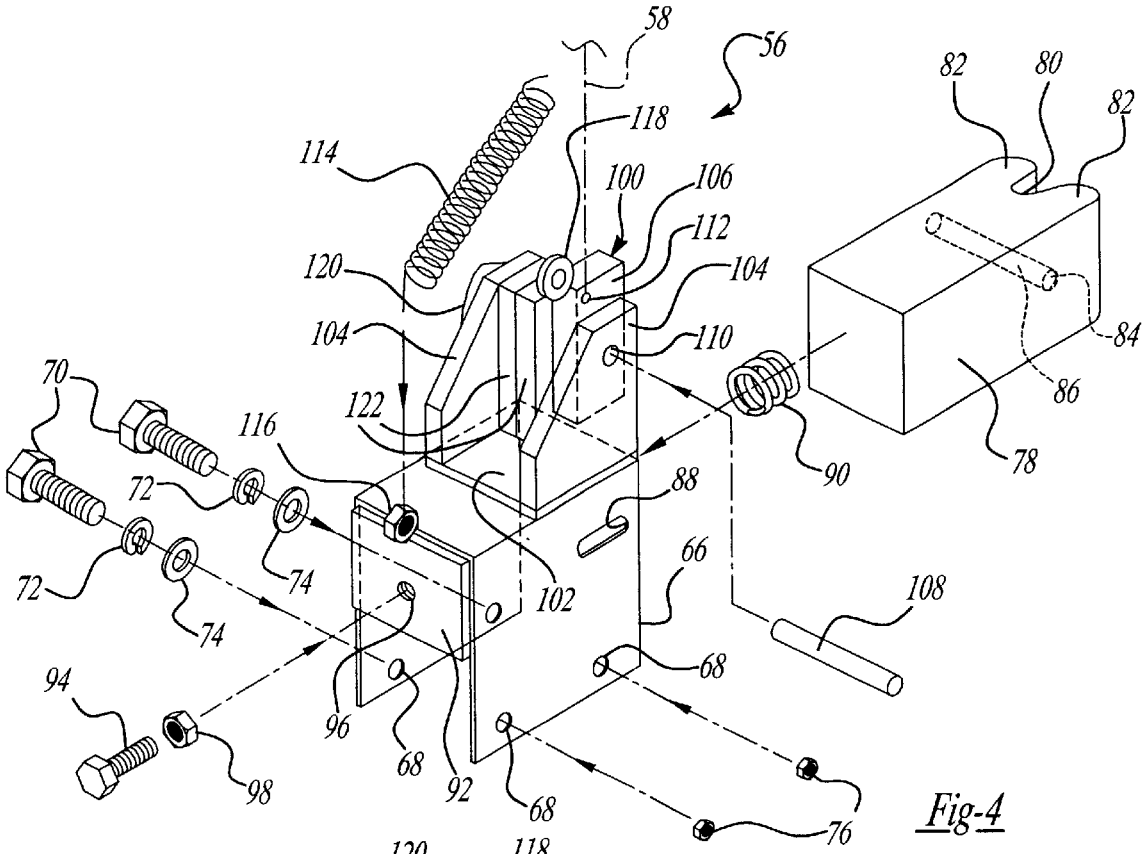
FIG. 4 is an exploded view of a release assembly for the releasable vertical lift overhead door of FIG. 1.
Figure 5:
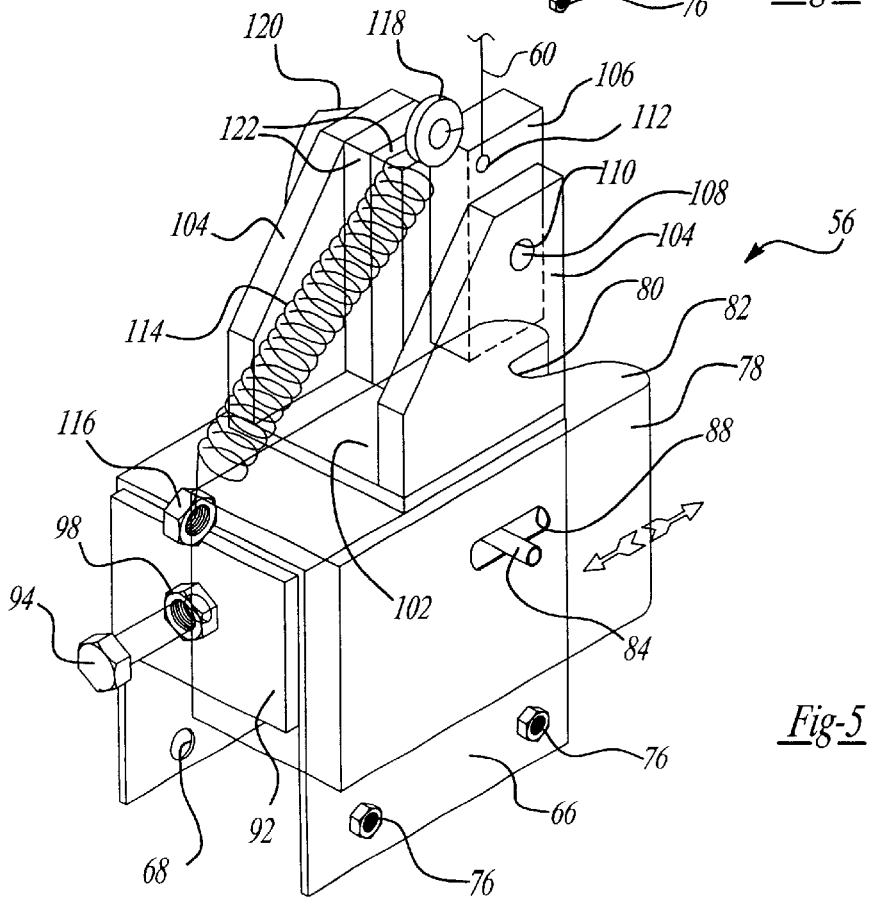
FIG. 5 is a perspective view of the release assembly for the releasable vertical lift overhead door of FIG. 1.
Figure 6:
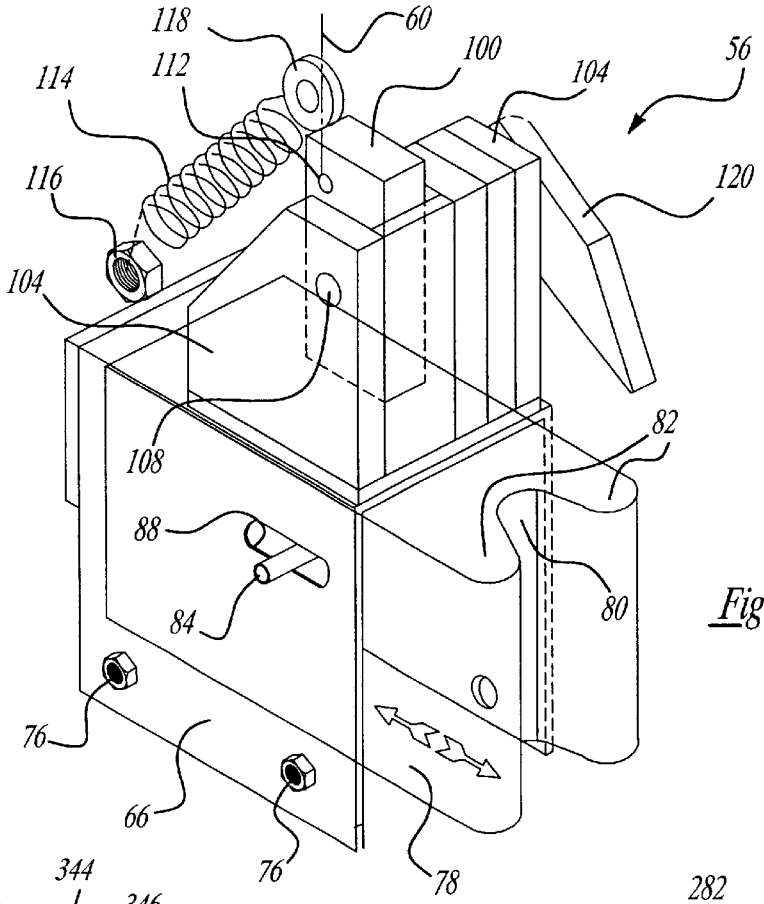
FIG. 6 is another perspective view of the release assembly for the releasable vertical lift overhead door of FIG. 1.

Referring to FIGS. 4 through 6, the release assembly 56 includes a support bracket 66. The support bracket 66 has a generally inverted U-shape and extends transversely. The support bracket 66 has at least one, preferably a pair of apertures 68 spaced transversely and extending therethrough. The support bracket 66 is disposed over the top cap 18 of the top panel 16 of the door leaf 14 and secured thereto by suitable fastening means such as a bolt 70, lock washer 72, flat washer 74 and nut 76. It should be appreciated that the bolt 70 extends through the apertures 68 in the support bracket 66 and corresponding apertures (not shown) in the top cap 18 and top panel 16 of the door leaf 14.

The release assembly 56 includes a guide bar 78 disposed within the support bracket 66. The guide bar 78 is generally rectangular in shape with a recess 80 at one end for receiving the track 52. The recess 80 has a generally parabolic shape and extends vertically therethrough to form fingers 82 disposed over the track 52. The parabolic shape of the recess 80 provides inclined surfaces of the fingers 82 for contact with an arcuate portion of the track 52 to cause movement of the guide member 78 relative to the track 52 upon a force being applied to the release assembly 56. It should be appreciated that the guide member 78 guides movement of the door leaf 14 along the track 52.

The release assembly 56 also includes a plunger 84 extending through an aperture 86 in the guide bar 78. The plunger 84 is generally cylindrical and circular in cross-sectional shape and extends longitudinally through the guide bar 78 and a pair of elongated and transversely extending slots 88 in the support bracket 66. The plunger 84 cooperates with the slots 88 to limit the travel of the guide bar 78 relative to the support bracket 66.

The release assembly 56 also includes a spring 90 such as a coil spring to urge the guide bar 78 toward the track 52 for engagement therewith. The spring 90 is disposed between an end of the guide bar 78 and a backing plate 92 secured to an end of the support bracket 66 by suitable means such as welding. The release assembly 56 includes a spring guide 94 such as a bolt extending through a threaded aperture 96 in the backing plate 92 and secured thereto with a nut 98 to guide the spring 90. It should be appreciated that the spring 90 is partially disposed over a shaft of the spring guide 94. It should also be appreciated that the guide bar 78 is urged outwardly by the spring 90 and can move back and forth relative to the track 52 as shown by arrows.

The release assembly 56 further includes a latch assembly, generally indicated at 100, for tripping the open limit switch 50. The latch assembly 100 includes a generally rectangular bottom plate 102 secured to a top of the support bracket 66 by suitable means such as welding. The latch assembly 100 includes a pair of side plates 104 spaced longitudinally and extending vertically and secured to the bottom plate 102 by suitable means such as welding. The latch assembly 100 includes a latch plate 106 disposed between the side plates 104 and pivotally connected thereto by a shaft 108 extending through corresponding apertures 110 in the side plates 104 and latch plate 106. The latch plate 106 also includes an aperture 112 extending therethrough to which the metal wire rope cable 58 is attached to the release assembly 56.

The latch assembly 100 includes a spring 114 such as a coil spring having one end attached to a nut 116 secured to the support bracket 66 and backing plate 92 by suitable means such as welding and another end attached to a washer 118 secured to the latch plate 106 by suitable means such as welding. The latch assembly 100 includes a latch 120 attached to the shaft 108 on one side of one of the side plates 104 and extending transversely. The latch assembly 100 may also include one or more support plates 122 disposed between the latch plate 106 and side plates 104 and secured to the bottom plate 102 by suitable means such as welding to support the shaft 108. It should be appreciated that the latch 120 can rotate with the shaft 108 and is urged outwardly by the spring 114.

The releasable vertical lift overhead door 10 may include one or more brush seals 124 attached to the door leaf 14 by suitable means and extending vertically to prevent contaminants from entering the tracks 52. The releasable vertical lift overhead door 10 may include one or more brush seals 126 extending horizontally between the structure 13 to prevent contaminants from getting past the door leaf 14. It should be appreciated that the seals 124 and 126 are conventional and known in the art.

Figure 7:
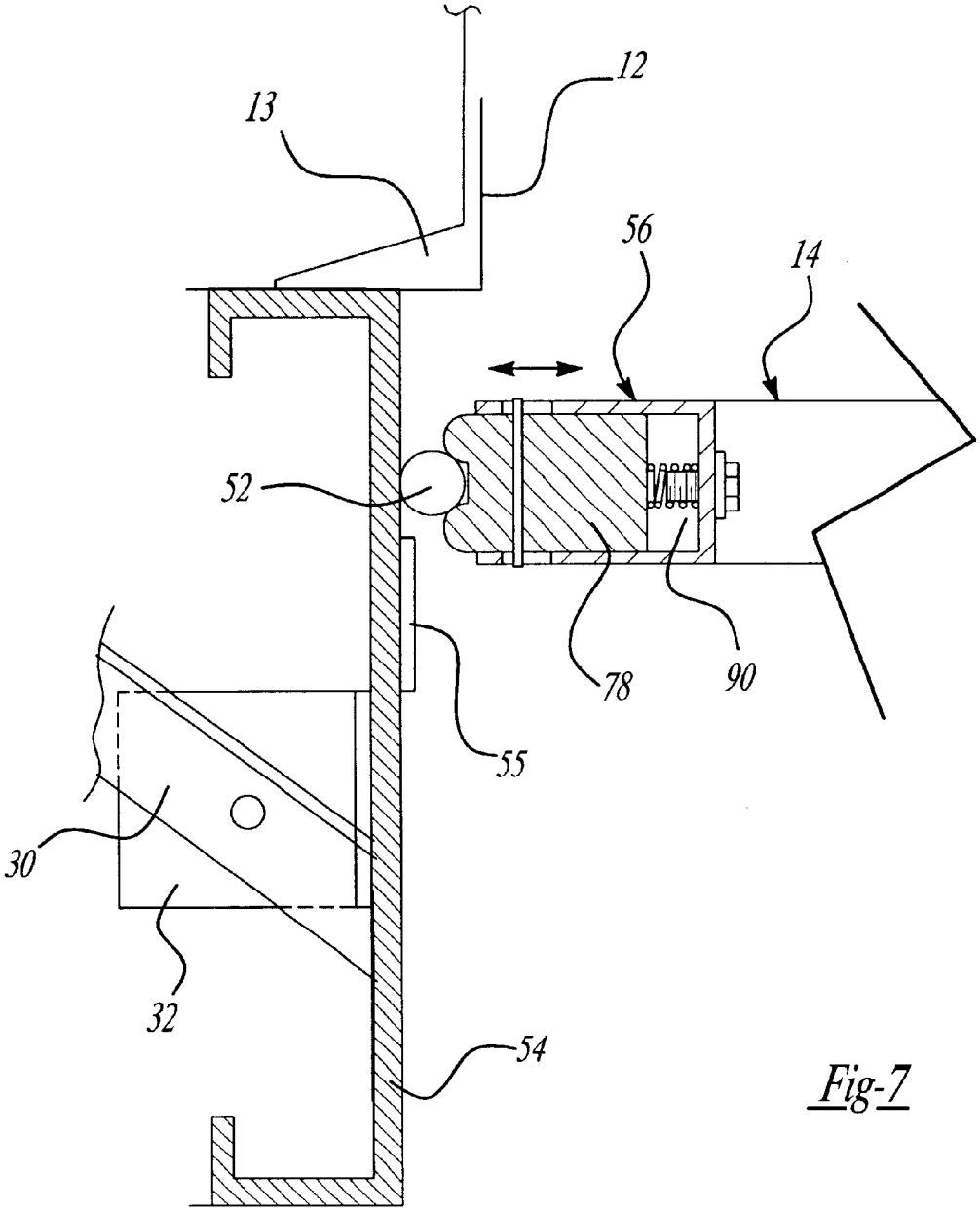
FIG. 7 is a fragmentary plan view of a portion of the releasable vertical lift overhead door of FIG. 1.
Figure 8:
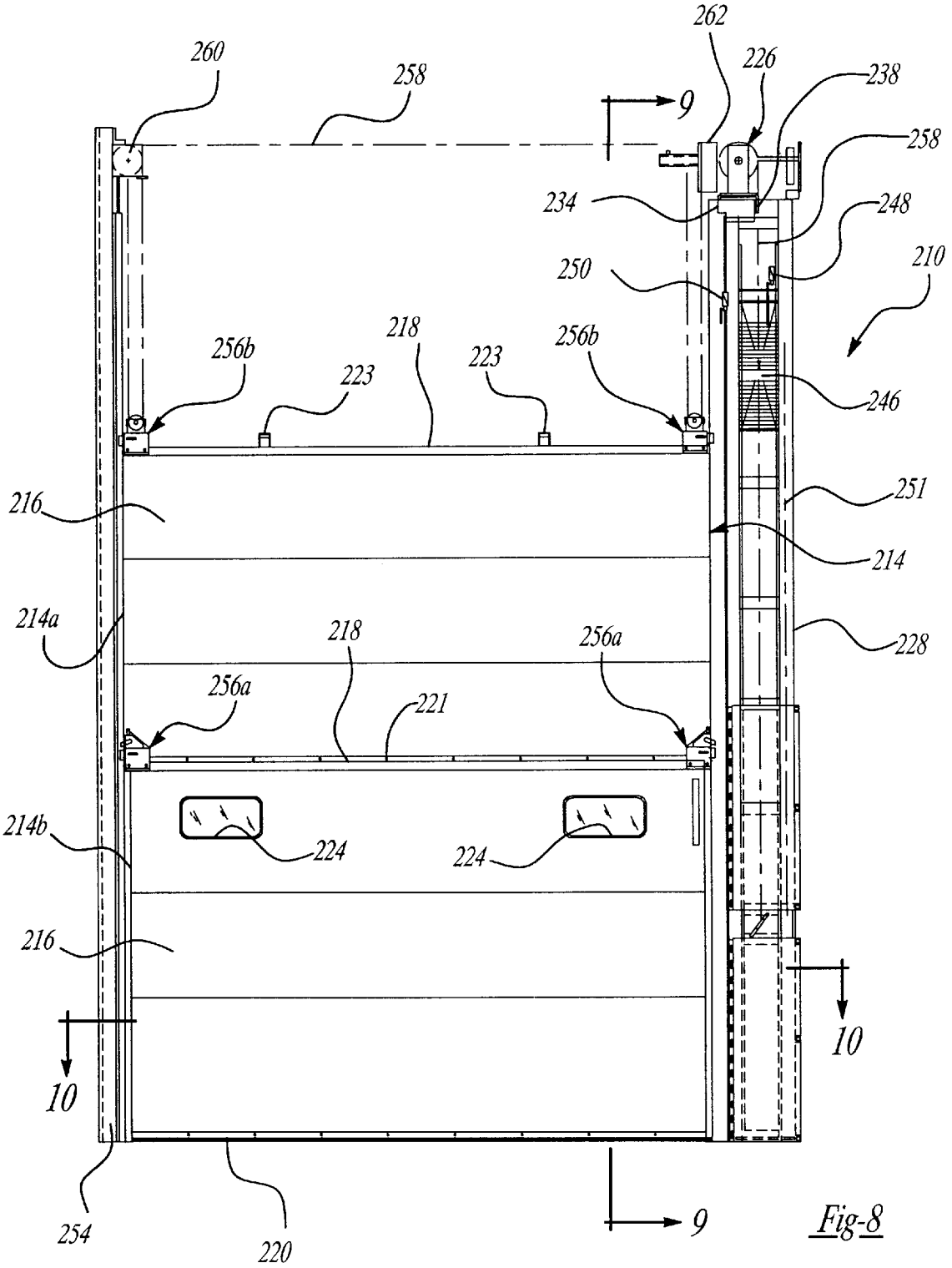
FIG. 8 is a front elevational view of another embodiment, according to the present invention, of the releasable vertical lift overhead door of FIG. 1.
Figure 9:
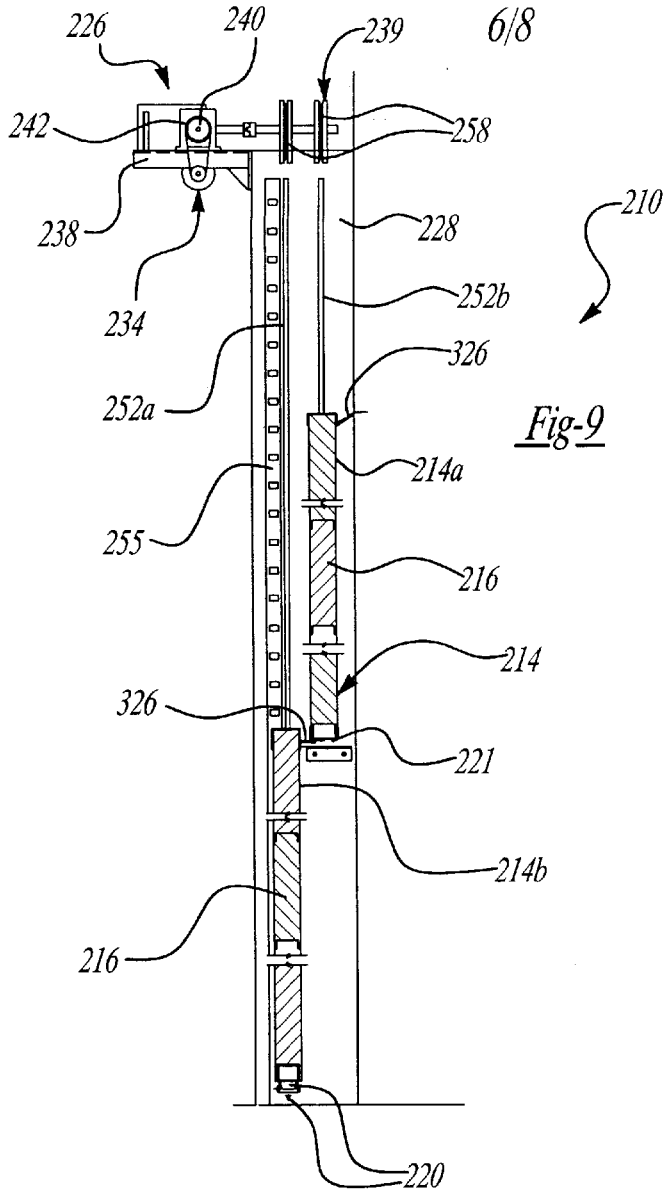
FIG. 9 is a sectional view taken along line 9—9 of FIG. 8.
Figure 10:
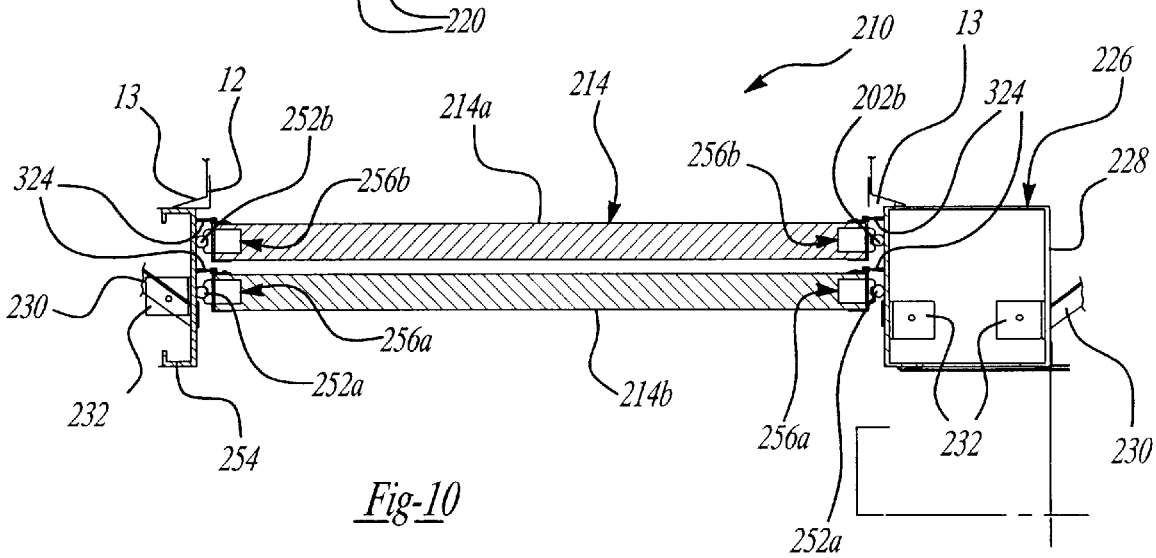
FIG. 10 is a sectional view taken along line 10—10 of FIG. 8.

In operation of the releasable vertical lift overhead door 10, the door leaf 14 is disposed between the tracks 52 such that the guide bars 78 are disposed about the tracks 52 as illustrated in FIGS. 1, 3 and 7. The lift assembly 26 lifts the door leaf 14 when an operator starts the motor assembly 34 via the control panel. The motor assembly 34 rotates the drive drum assembly 39 and moves the metal wire rope cable 58 and lowers the counterweight box 46. When the latch assembly 100 trips the open limit switch 50, power is discontinued to the motor assembly 34 and the opening 12 is open to allow passage therethrough. When an operator starts the motor assembly 34 again via the control panel, the motor assembly 34 reverses direction to lower the door leaf 14 and raise the counterweight box 46. When the counterweight box 46 trips the close limit switch 48, power is discontinued to the motor assembly 34 and the opening 12 is closed to prevent passage therethrough.

If, at any time, a force of a predetermined magnitude is applied to the door leaf 14, the guide bar 78 is forced against the track 52 and moves solely in a linear direction transversely with respect a longitudinal axis of the track and inwardly to compress the spring 90 such that the guide bar 78 moves longitudinally past the track 52. The door leaf 14 is then released from engagement with the track 52 and may move longitudinally outwardly with respect to the opening 12 if the force is applied to the interior side of the door leaf 14 or may move longitudinally inwardly with respect to the opening 12 if the force is applied to the exterior side of the door leaf 14. It should be appreciated that, if the door leaf 14 is disengaged from the tracks 52, the door leaf 14 is suspended by the metal wire rope cable 58 via the release assemblies 56. It should be appreciated that the door leaf 14 can be engaged with the tracks 52 again upon moving the guide bars 78 transversely inwardly and releasing them when aligned with the tracks 52 such that the spring 90 moves the guide bar 78 transversely outwardly such that the tracks 52 are received in the recesses 80 and the fingers 82 of the guide bars 78 fit over the tracks 52.

Referring to FIGS. 8 through 13, another embodiment, according to the present invention, of the releasable vertical lift overhead door 10 is shown. Like parts of the releasable vertical lift overhead door 10 have like reference numerals increased by two hundred (200). The releasable vertical lift overhead door 210 includes a plurality of door leafs 114. Preferably, the releasable vertical lift overhead door 210 includes an upper door leaf 214*a* and a lower door leaf 214*b*. The door leafs 214*a* and 214*b* are similar to the door leaf 14 of FIGS. 1 through 3. However, only the lower door leaf 214*b* includes the vision lites 224. The door leaf 214*a* and 214*b* each include the panels 216, top cap 218 and boot 220. The door leaf 214*a* also includes a bottom cap 221 on a bottom panel 216 thereof and a pair of stop devices 223 spaced transversely along the top cap 218.

The releasable vertical lift overhead door 210 also includes the lift assembly 226 including the tower 228 and motor assembly 234. In this embodiment, the releasable vertical lift overhead door 210 includes a pair of tracks 252*a* and 252*b* disposed along each side of the opening 12. The tracks 252*a* and 252*b* are spaced longitudinally. It should be appreciated that the track 252*b* may extend only partially along the tower 228 and track support member 254.

The releasable vertical lift overhead door 210 includes a release assembly 256 attached to a top of the lower door leaf 214*b* which is similar to the release assembly 56 of FIGS. 4 through 6. The releasable vertical lift overhead door 210 also includes a release assembly 256 attached to a top of the door leaf 214*a* on each side thereof engageable with the tracks 252*b*.

Figure 11:
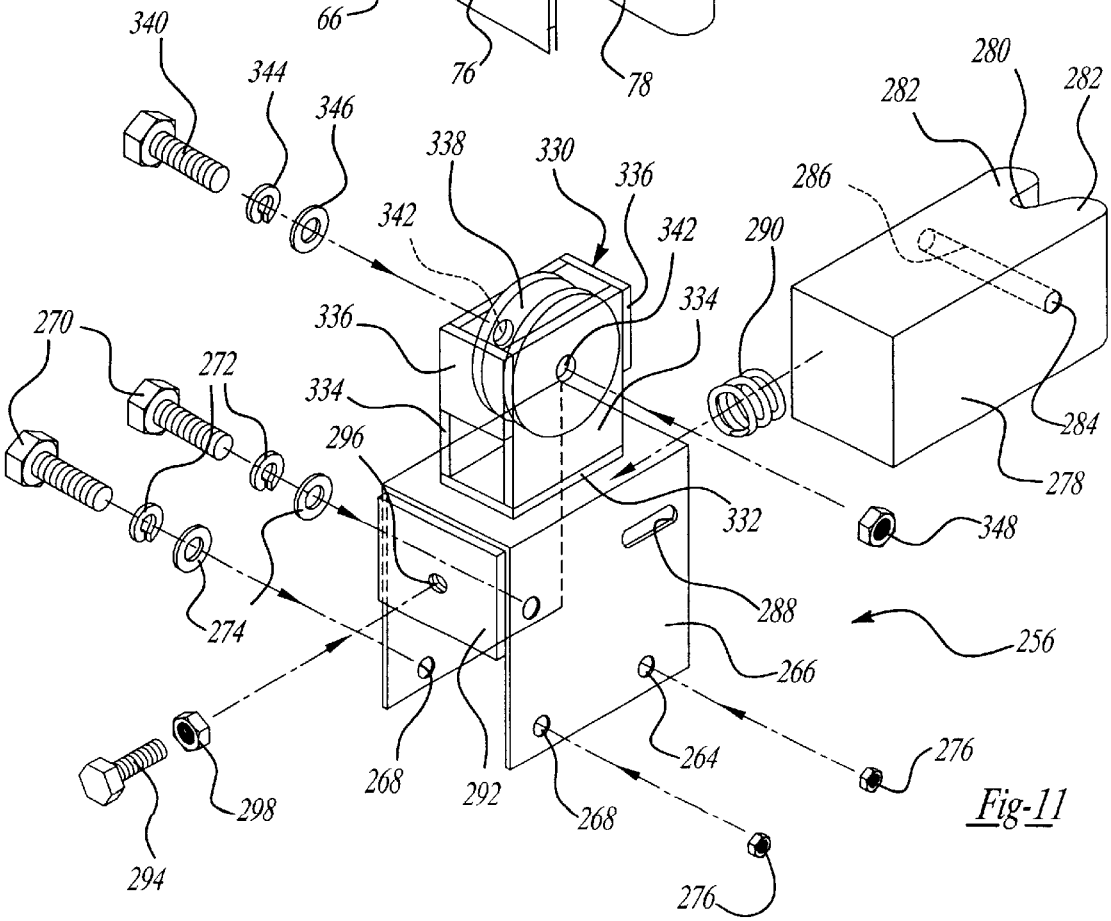
FIG. 11 is an exploded view of another release assembly for the releasable vertical lift overhead door of FIG. 8.
Figure 12:
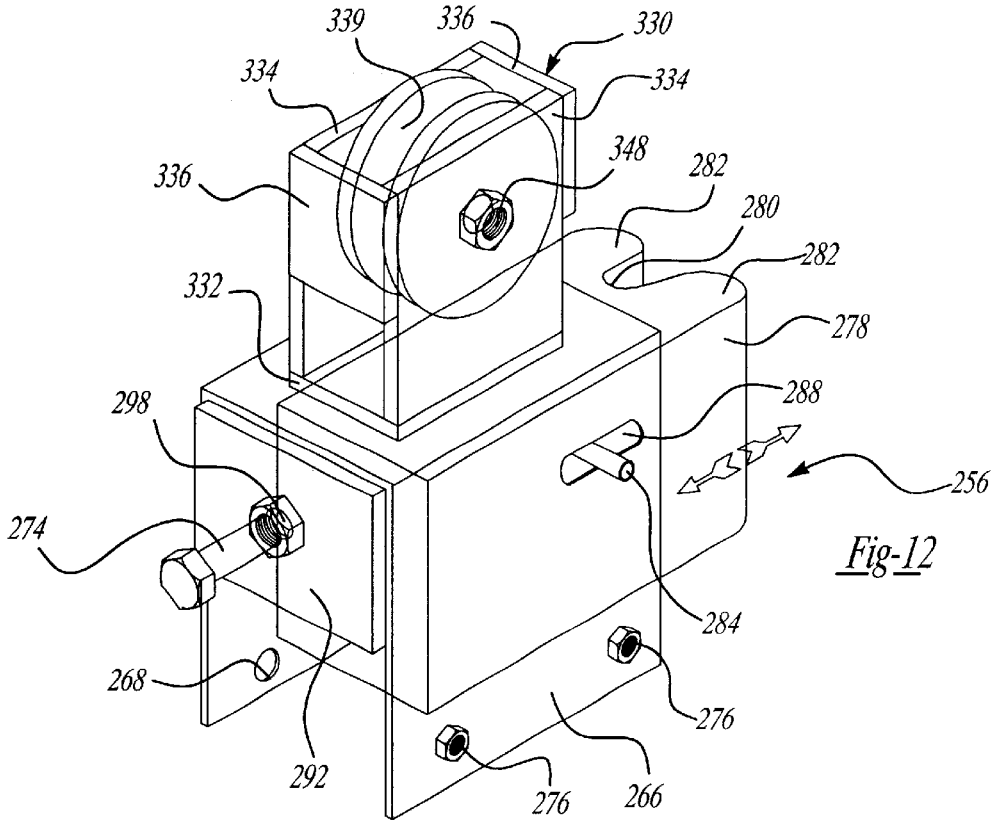
FIG. 12 is a perspective view of the release assembly for the releasable vertical lift overhead door of FIG. 8.
Figure 13:
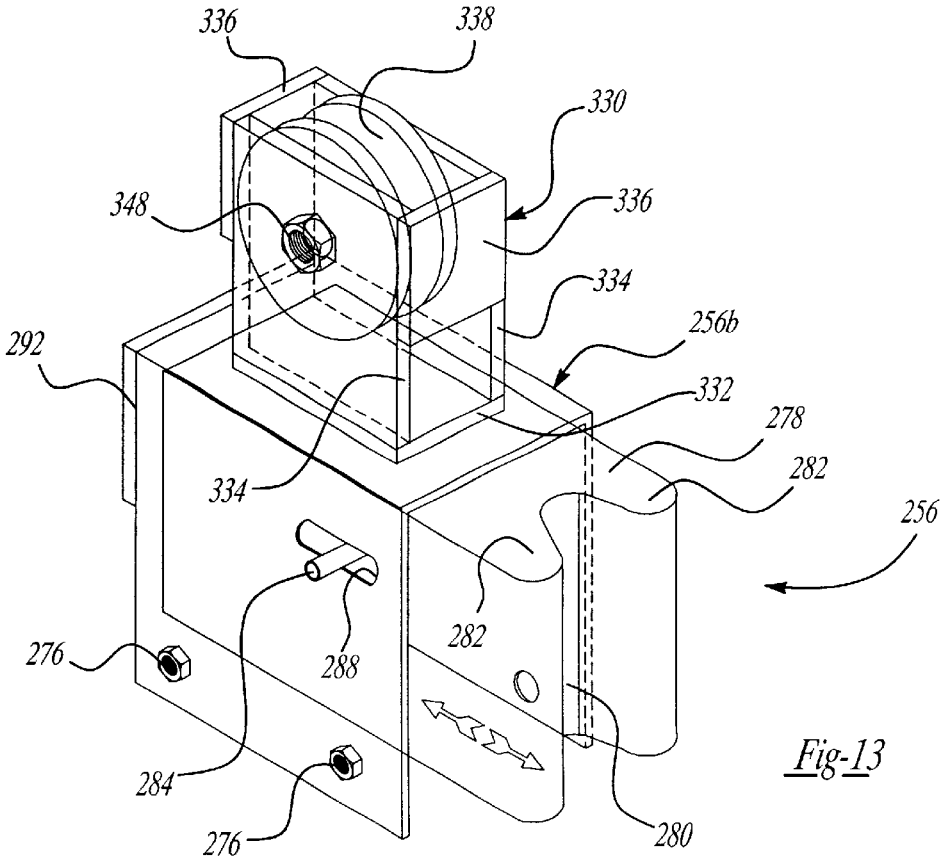
FIG. 13 is another perspective view of the release assembly for the releasable vertical lift overhead door of FIG. 7.

As illustrated in FIGS. 11 through 13, the release assembly 256*b* is similar to the release assembly 56 of FIGS. 4 through 6 but omits the latch assembly 100 and includes a pick-up sheave assembly 330. The pick-up sheave assembly 330 includes a generally rectangular bottom plate 332 secured to a top of the support bracket 266 by suitable means such as welding. The pick-up sheave assembly 330 also includes a pair of side plates 334 spaced longitudinally and extending vertically and secured to the bottom plate 332 by suitable means such as welding. The pick-up sheave assembly 330 also includes a generally rectangular end plate 336 extending longitudinally and secured to the side plates 334 by suitable means such as welding. The pick-up sheave assembly 330 includes a pulley or sheave 338 disposed between the side plates 334. The pick-up sheave assembly 330 also includes a bolt 340 extending through apertures 342 in the side plates 334 and sheave 338 and secured thereto by suitable means such as a lock washer 344, flat washer 346 and nut 348. It should be appreciated that the sheave 338 rotates relative to the bolt 340.

The releasable vertical lift overhead door 210 also includes the metal wire rope cable 258 having one end connected to the release assembly 256*a* and extending over rotatable guide sheaves 260 and 262 and extending over the drive drum assembly 239 and attached by suitable means to the counterweight box 246. The releasable vertical lift overhead door 210 also includes the metal wire rope cable 258 extending from the rotatable guide sheaves 260 and down to sheave 338 of the pick-up sheave assembly 330 for the door leaf 214*a* and up to the guide sheave 260 to the drive drum assembly 239 then to the counterweight box 246. It should be appreciated that the metal wire rope 258 is attached to the other side of the door leaf 214 in a similar manner.

The releasable vertical lift overhead door 210 may include one or more brush seals 324 extending vertically along the door leaf 214 and one or more brush seals 326 extending horizontally across the door leaf 214.

In operation of the releasable vertical lift overhead door 210, the door leafs 214*a* and 214*b* are disposed between the tracks 252*a* and 252*b*, respectively, such that the guide bars 278 are disposed about the tracks 252*a* and 252*b*. The lift assembly 226 lifts the door leafs 214*a* and 214*b* when an operator starts the motor assembly 234 via the control panel. The motor assembly 234 rotates the drive drum assembly 239 and moves the metal wire rope cable 258 and lowers the counterweight box 246. When the latch assembly 300 trips the open limit switch 250, power is discontinued to the motor assembly 234 and the opening 12 is opened to allow passage therethrough. When an operator starts the motor assembly 234 again via the control panel, the motor assembly 234 reverses direction to lower the door leafs 214*a* and 214*b* and raise the counterweight box 246. When the counterweight box 246 trips the close limit switch 248, power is discontinued to the motor assembly 234 and the opening 212 is closed to prevent passage therethrough.

If, at any time, a force of a predetermined magnitude is applied to either door leaf 214*a* or 214*b*, the guide bar 278 is forced against the track 252*a* or 252*b* and moves transversely inwardly to compress the spring 290 such that the guide bar 278 moves longitudinally past the track 252*a* or 252*b*. The door leaf 214 is then released from engagement with the track 252*a* or 252*b* and may move longitudinally outwardly with respect to the opening 12 if the force is applied to the interior side of the door leaf 214*a* or 214*b* or may move longitudinally inwardly with respect to the opening 12 if the force is applied to the exterior side of the door leaf 214*a* or 214*b*. It should be appreciated that either one or both door leafs 214*a* and 214*b* can be disengaged from the tracks 252*a* and 252*b* simultaneously. It should also be appreciated that the metal wire rope cable 258 suspends the door leafs 214*a* and 214*b* via the release assemblies 256 when disengaged from the tracks 252*a* and 252*b*.

The present invention has been described in an illustrative manner. It is to be understood that the terminology which has been used is intended to be in the nature of words of description rather than of limitation.

Many modifications and variations of the present invention are possible in light of the above teachings. Therefore, within the scope of the appended claims, the present invention may be practiced other than as specifically described.

What is claimed is:

1. A releasable vertical lift overhead door for an opening of a structure comprising:

a plurality of tracks, one of a pair of said tracks adapted to be disposed on a side of the opening of the structure and another of the pair of said tracks adapted to be disposed on another side of the opening;

at least one door leaf disposed between the pair of said tracks; and release assemblies each attached to a respective side of said at least one door leaf, each said release assembly having a support bracket attached to said at least one door leaf and a guide bar disposed within said support bracket for receiving a portion of a respective one of the pair of said tracks therein to guide movement of said at least one door leaf along the pair of said tracks, each said guide bar being movable solely in a linear direction perpendicular to a longitudinal axis of the respective one of the pair of said tracks to releasably disengage the respective one of the pair of said tracks when a force of a predetermined magnitude is applied to said at least one door leaf.

2. A releasable vertical lift overhead door as set forth in claim 1 wherein said at least one door leaf comprises a plurality of panels interlocked together and fixed relative to each other.

3. A releasable vertical lift overhead door as set forth in claim 1 wherein each one of the pair of said tracks has an arcuate portion.

4. A releasable vertical lift overhead door as set forth in claim 3 wherein each said release assembly includes a spring to urge said guide bar into engagement with the respective one of the pair of said tracks.

5. A releasable vertical lift overhead door as set forth in claim 4 wherein each said guide bar has a recess at one end for receiving said arcuate portion of the respective one of the pair of said tracks.

6. A releasable vertical lift overhead door as set forth in claim 5 wherein each said recess has a generally parabolic shape.

7. A releasable vertical lift overhead door as set forth in claim 4 wherein for each said release assembly, said support bracket is attached to an edge of said at least one door leaf with said guide bar being disposed between said support bracket and said at least one door leaf and said spring being disposed between said guide bar and said support bracket.

8. A releasable vertical lift overhead door as set forth in claim 1 including a cable attached to said release assemblies.

9. A releasable vertical lift overhead door as set forth in claim 8 including a drive drum assembly mounted above said at least one door leaf to suspend said cable.

10. A releasable vertical lift overhead door as set forth in claim 9 including a motor assembly for rotating said drive drum assembly to extend and retract said cable.

11. A releasable vertical lift overhead door as set forth in claim 1 wherein said at least one door leaf comprises an upper door leaf and a lower door leaf.

12. A releasable vertical lift overhead door as set forth in claim 11 wherein the pair of said tracks comprise a first pair of tracks and a second pair of tracks spaced from said first pair of tracks, said upper door leaf being disposed adjacent said first pair of tracks and said lower door leaf being disposed adjacent said second pair of tracks.

13. A releasable vertical lift overhead door as set forth in claim 12 wherein said release assemblies each include a pick-up sheave assembly having a rotatable sheave.

14. A releasable vertical lift overhead door for an opening of a structure comprising:

a pair of opposed tracks, each of said tracks adapted to be disposed on a respective side of the opening of the structure;

a door leaf having a plurality of panels interlocked together and fixed relative to each other, said door leaf being disposed between said tracks; and a pair of release assemblies each attached to a respective side of said door leaf, each said release assembly having a support bracket attached to said door leaf and a guide bar disposed within said support bracket for receiving a portion of a respective one of said tracks therein to guide movement of said door leaf along said tracks, each said guide bar being movable solely in a linear direction perpendicular to a longitudinal axis of said respective one of said tracks to releasably disengage said tracks when a force of a predetermined magnitude is applied to said door leaf.

15. A releasable vertical lift overhead door as set forth in claim 14 wherein each of said tracks has an arcuate portion.

16. A releasable vertical lift overhead door as set forth in claim 15 wherein each said release assembly includes a spring to urge said guide bar into engagement with said respective one of said tracks.

17. A releasable vertical lift overhead door as set forth in claim 16 wherein each said guide bar has a recess at one end for receiving said arcuate portion of said respective one of said tracks.

18. A releasable vertical lift overhead door as set forth in claim 17 wherein each said recess has a generally parabolic shape.

19. A releasable vertical lift overhead door as set forth in claim 18 wherein for each said release assembly, said support bracket is attached to an edge of said door leaf with said guide bar being disposed between said support bracket and said door leaf and said spring being disposed between said guide bar and said support bracket.

20. A releasable vertical lift overhead door as set forth in claim 19 including a cable attached to said release assemblies.

21. A releasable vertical lift overhead door as set forth in claim 20 including a drive drum assembly mounted above said door leaf to suspend said cable.

22. A releasable vertical lift overhead door as set forth in claim 21 including a motor assembly for rotating said drive drum assembly to extend and retract said cable.

23. A releasable vertical lift overhead door for an opening of a structure comprising:

two pairs of opposed tracks, each track of each of said two pairs of said tracks adapted to be disposed on a respective side of the opening of the structure;

an upper door leaf and a lower door leaf each disposed between a respective one of the pairs of said tracks; and release assemblies attached to sides of said upper door leaf and said lower door leaf, each said release assembly having a support bracket attached to a respective one of said upper door leaf and said lower door leaf and a guide bar disposed within said support bracket for receiving a portion of a respective one said tracks therein to guide movement of said upper door leaf and said lower door leaf along said tracks, each said guide bar being movable solely in a linear direction perpendicular to a longitudinal axis of said respective one of said tracks to releasably disengage said tracks when a force of a predetermined magnitude is applied to the respective one of said upper door leaf and said lower door leaf.

24. A releasable vertical lift overhead door as set forth in claim 23 wherein said upper door leaf and said lower door leaf each comprises a plurality of panels interlocked together and fixed relative to each other.

25. A releasable vertical lift overhead door as set forth in claim 24 wherein each of said tracks has an arcuate portion.

26. A releasable vertical lift overhead door as set forth in claim 25 wherein each said release assembly includes a spring to urge said guide bar into engagement with said respective one of said tracks.

27. A releasable vertical lift overhead door as set forth in claim 26 wherein each said guide bar has a recess at one end for receiving said arcuate portion of said respective one of said tracks.

28. A releasable vertical lift overhead door as set forth in claim 27 wherein each said recess has a generally parabolic shape.

29. A releasable vertical lift overhead door as set forth in claim 28 wherein for each said release assembly, said support bracket is attached to an edge of the respective one of said upper door leaf and said lower door leaf, with said guide bar being disposed between said support bracket and the respective one of said upper door leaf and said lower door leaf and said spring being disposed between said guide bar and said support bracket.

30. A releasable vertical lift overhead door as set forth in claim 29 wherein said release assemblies for said upper door leaf each includes a pick-up sheave assembly having a rotatable sheave.

31. A releasable vertical lift overhead door as set forth in claim 30 including a cable attached to said release assemblies.

32. A releasable vertical lift overhead door as set forth in claim 31 including a drive drum assembly mounted above said upper door leaf to suspend said cable.

33. A releasable vertical lift overhead door as set forth in claim 32 including a motor assembly for rotating said drive drum assembly to extend and retract said cable.

* * * * *

UNITED STATES PATENT AND TRADEMARK OFFICE

CERTIFICATE OF CORRECTION

PATENT NO. : 6,434,886 B1
DATED : August 20, 2002
INVENTOR(S) : Andrew P. Johnson and David Stiltner It is certified that error appears in the above-identified patent and that said Letters Patent is hereby corrected as shown below:

Column 5,
Line 50, “respect a” should read -- respect to a --.

Column 9,
Line 13, “one said” should read -- one of said --.

Column 10,
Line 4, “leaf, with” should read -- leaf with --.

Signed and Sealed this

Twenty-eighth Day of January, 2003

JAMES E. ROGAN
*Director of the United States Patent and Trademark Office*